United States Patent [19]

Cieslak

[11] 4,206,567

[45] Jun. 10, 1980

[54] COMBINATION FIGURE TOY AND TOY BIN

[76] Inventor: Edith E. Cieslak, 3310 N. Main St., Soquel, Calif. 95073

[21] Appl. No.: 848,341

[22] Filed: Jun. 5, 1978

[51] Int. Cl.[2] ..... A63H 3/00

[52] U.S. Cl. ..... 46/116; D6/152; D6/154; 46/153; 312/204

[58] Field of Search ..... 46/11, 115, 116, 117, 46/118, 153; D6/151, 152, 153, 154; D21/148, 149, 151, 166, 167; 312/204

[56] References Cited

U.S. PATENT DOCUMENTS

| | | | |
|---|---|---|---|
| 88,438 | 3/1969 | Aylworth | 35/27 |
| D. 226,101 | 1/1973 | Marcus | D21/149 |
| D. 232,287 | 8/1974 | Forrester | D6/152 |
| D. 232,680 | 9/1974 | Forrester | D6/152 |
| 1,543,351 | 6/1925 | Webb | 46/115 |
| 2,052,594 | 9/1936 | Antell | 46/11 |
| 2,288,798 | 7/1942 | Fleming | 46/151 |
| 2,551,433 | 3/1951 | Graves | 35/27 |
| 2,551,560 | 3/1951 | Graves | 35/27 |
| 2,678,505 | 5/1954 | Munson | 35/17 |

FOREIGN PATENT DOCUMENTS

| | | | |
|---|---|---|---|
| 1020462 | 11/1952 | France | 46/153 |

*Primary Examiner*—F. Barry Shay

[57] ABSTRACT

A combination of a toy and a piece of furniture which is in the form of a figure representing an adult female mammal such as a human. The figure has a bin located in the lower torso in the form of a removable drawer. One or more baby dolls may be placed in the bin, as in a bed. Holes may be provided in the bin bottom and laces may be used therewith to secure the dolls and/or to secure the bin to the adult doll as a backpack. They also allow the child to practice lacing and bow-tying. The bin has an external knob which when placed against the floor, serves as a support about which the bin containing the babies may be rocked. The location of the bin in the female figure familiarizes the child with the general anatomical location of the source of babies.

1 Claim, 5 Drawing Figures

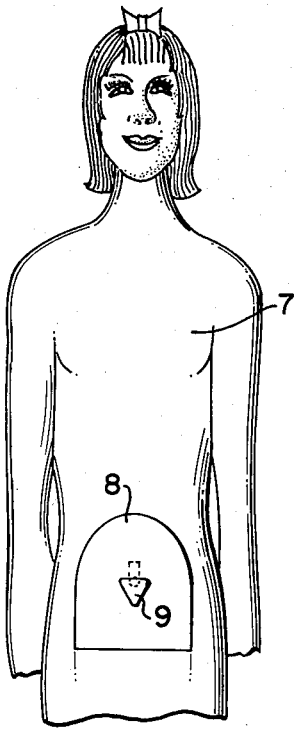
FIG. 1
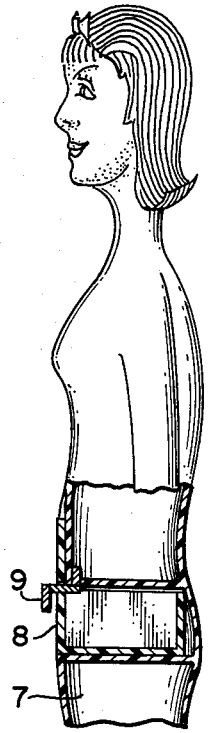
FIG. 2
FIG. 3
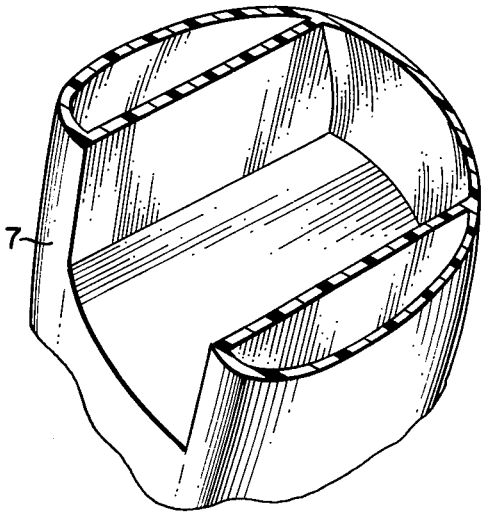
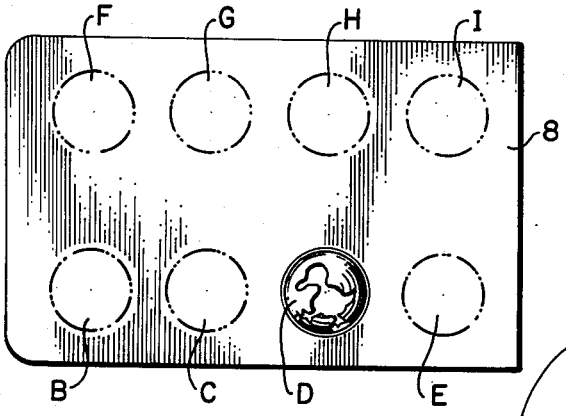
FIG. 5
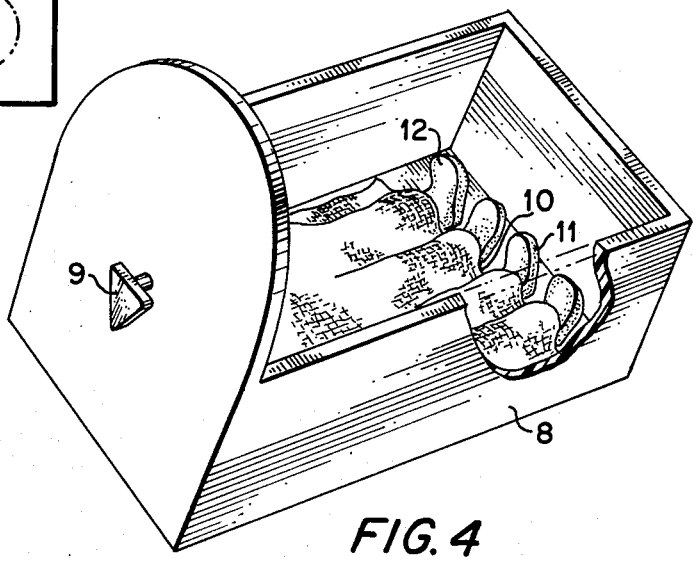
FIG. 4

COMBINATION FIGURE TOY AND TOY BIN

PRIOR ART

An inspection of the Patent Records by professional searchers in June of 1975 has produced: U.S. Pat. Nos. 2,551,433 and 2,551,560 by inventor Julia Graves on Mar. 1, 1951. Her mother manikins are each an apparatus, life size, for teaching the complete course of Obstetrics and Midwifery.

The only other item produced was by inventor B. H. Aylworth, U.S. Pat. No. 88,438, patented Mar. 30, 1869. He invented the adult life size Manikin and Fetus, for obstetrics and for midwifery.

BRIEF SUMMARY OF THE INVENTION

At first glance this roomy versatile toy doll bin gives the impression it is only a bed. But it not only serves as a sleeping place, it has several other uses and needs that a bed cannot accomplish. A bed does not have the following desirable uses found in the toy doll bin.

A child gets space for three dolls that do not take up any more room than one doll. When the doll twins are in their bin, in their mother doll body cavity, they are out of the way, thus not making any clutter or requiring additional storage space. The twins cannot become misplaced or damaged. The bin protects and eliminates any extra cost for packing to ship. And this instant family is easily found when the child wants them.

The present invention, the toy doll bin, is unique and useful in assorted ways of versatile nature. When removed from its storage location, it can be noted the bin has six large clearly defined silhouettes punched through the floor, plus a cord to lace through the holes (like in lacing a shoe). And this lacing of the cord, instructs the child in the art of lacing a shoe and perfecting a bowknot that will hold. One of the unavoidable needs in life are securely tied shoes and the art of lacing, using these unique holes, can be practiced with the bin upside down or right side up. A bed has never been instrumental in teaching a child to lace a shoe or tie a bowknot.

When the toy doll bin has been removed from the mother doll body cavity, it doubles as an outdoor backpack carrier. The twins can be laced in the carrier (as lacing of a shoe) and the bowknot slipped over the mother doll head with the bow in front and this contraption hangs as a simple, adequate and inexpensive outdoor traveling bin. While the twins are laced in this new invention, they also can be hung on a tree twig or any low lying reachable protruberance that a mother would find suitable to temporarily place her children. This is not unlike the Indian mother of long ago, carrying her papoose on her back, using a swaying limb to rock the papoose to sleep.

DESCRIPTION OF THE DRAWINGS

FIG. 1 is a front view of the adult figure showing the bin in place;

FIG. 2 is a side view partly in cross-section showing the bin catch and handle;

FIG. 3 is a sectional view taken on a plane through the cavity which receives the bin;

FIG. 4 is a top view of the bin serving in its capacity as a bed for twin dolls;

FIG. 5 is the bin viewed from the bottom and shows eight holes therein, only one being shown in detail as a bumplike animal cutout area.

DETAILED DESCRIPTION OF THE PREFERRED EMBODIMENTS

State agencies endeavoring to raise the standard of technique of lacing the shoes and tying an enduring bowknot, are confronted with the vast problem of hundreds of young children still struggling and not yet able to tie their shoes and keep them tied after they are enrolled in school. Among other things this invention relates to, by an interesting and easily understood manner, the fun way to master this shoe tying at an early age, to become neater and to instill self-sufficiency. The following disclosure shows how this is accomplished:

Bin 8 may be turned on end and used as a backpack for mother doll 7 when she is conceived of as a traveler. Twins 11, 12 may be laced into bin 8 with the headboard extended above them to be used as an overhead shelter from rain and sun. As a papoose carrier, bin 8 may have included with it cover 10 and the carrier can easily be arranged to swing from a tree limb. Ability to use bin 8 as a backpack requires little more than that the child user to be given stimulating encouragement to accomplish the art of tying the laces (not shown) in a manner similar to the tying of shoes. This art may be used throughout a lifetime. The play situation envisioned can stimulate in a child an urgency to get twins 11,12 ready for their outdoor trip.

Lace tips from the bowknot may hang down into the empty lower cavity of mother doll 7 so as to be no hindrance when bin 8 is pushed into its storage space, because space may be provided for the purpose.

B,C,D,E,F,G,H, and I in FIG. 5 represents bumplike areas on the bottom of bin 8, each area including a hole with an outline of an animal or animal head silhouette associated with it. Outlines may be in the form of cutouts representing the animals or heads. They may be of a dog, cat, bear, monkey, sheep, cow, horse, pig, duck, fish or rabbit. A duck figure is shown in detail at D. The animal head cutouts may be arranged with the mouths of one row of four turned oppositely to those of the other row of four to furnish lacing hooks.

Bin 8 can stand upright, its headboard touching the floor. Locking member 9 on the front, which is used to hold bin 8 secure from slipping out when in stored position, now serves another purpose. The knob portion of member 9 at the center of the headboard enables bin 8, now thought of as a chair, to rock or rotate because it cannot sit flatly on the floor. Thus it becomes a rocking chair for twins 11,12. Another use for bin 8 (after removal from the cavity) is as a container to hold the owner's trinkets, or any desired objects. Another advantage concerning bin 8 is that its unique location familiarizes a child with the general location in the female body where babies are carried during pregnancy.

Bin 8 may slide into its prepared space on simple ledges, or cleats, made from plastic or some such substance. A solid wall or partition may be employed directly above bin 8 to keep its contents from falling into the upper part of the doll.

Bin 8 gives the purchaser more material merchandise for the money and the child, the receiver, gets a safe and educational toy that does not clutter.

The cost of this simple versatile commodity, is so slight that there is little need for any special equipment to make this bin with the exception of the punched out lacing holes in the floor of the Bin.

The materials used here can be any of the various lightweight nonmetallic compounds synthetically produced, and of a versatile plastic nature.

I claim:

1. A mother doll figure representing a species of mammal, said figure having a torso, a hollow interior in the lower portion of said torso said torso having a front opening communicating with said hollow interior, a removable toy bin receivable in said hollow interior, said bin having a floor and four upstanding walls, one of said walls closing said opening and forming a portion of an exterior surface of said figure when the bin is fully received in said hollow interior, said surface portion having an outwardly projecting knob secured thereon, said toy bin floor having a series of through holes therein, said bin being of a size to contain at least one baby doll representing the same species as said mother doll, and said holes being arranged in such a manner that they may be used to practice lacing and also to secure said baby doll in said bin by means of a lace.

* * * * *